United States Patent [19]

Pech

[11] Patent Number: 4,644,887

[45] Date of Patent: Feb. 24, 1987

[54] SEWING MACHINE WITH REVOLVING STITCH REGULATOR AND DISPLAY DEVICE

[75] Inventor: Winfried Pech, Kaiserslautern, Fed. Rep. of Germany

[73] Assignee: Pfaff Industriemaschinen GmbH, Fed. Rep. of Germany

[21] Appl. No.: 861,224

[22] Filed: May 8, 1986

[30] Foreign Application Priority Data

May 9, 1985 [DE] Fed. Rep. of Germany ..... 3516712

[51] Int. Cl.[4] ..... D05B 27/22; D05B 35/12

[52] U.S. Cl. ..... 112/315; 112/444

[58] Field of Search ..... 112/314, 315, 318, 319, 112/316, 317, 444, 445, 121.11

[56] References Cited

U.S. PATENT DOCUMENTS

| | | | |
|---|---|---|---|
| 2,643,625 | 6/1953 | Reimer | 112/315 |
| 4,064,817 | 12/1977 | Sawada et al. | 112/444 |
| 4,177,744 | 12/1979 | Wurst et al. | 112/457 |
| 4,196,682 | 4/1980 | Hanyu et al. | 112/444 |

*Primary Examiner*—Peter Nerbun

*Attorney, Agent, or Firm*—McGlew and Tuttle

[57] ABSTRACT

In a sewing machine with a device for setting the feed movement of a cloth feed by a revolving stitch regulator adjustable relative to the main shaft and comprising an eccentric which is connected to the cloth feed via a transmission and whose setting element is, after locking engagement with the housing of the sewing machine by a fixing element adjustable in stepwise setting amounts by rotation of the main shaft, and which is equipped with a display device for indicating the adjustment amount of the setting element, a pulse generator is coupled with the main shaft of the sewing machine for the visible display of the feed amount during operation of the machine. The pulse generator cooperates with markings which deliver pulses corresponding to the stepwise amounts and can be switched on via a switch actuable upon locking engagement of the setting element. The pulse generator is connected to a display unit via a pulse evaluating device.

6 Claims, 6 Drawing Figures

II
II

SEWING MACHINE WITH REVOLVING STITCH REGULATOR AND DISPLAY DEVICE

FIELD AND BACKGROUND OF THE INVENTION

The present invention relates in general to sewing machines and in particular to a new and useful sewing machine having a revolving stitch regulator which is adjustable for adjusting the feed movement of a feed cloth and which includes a display for displaying the adjusted position of the regulator, even when the sewing machine is operating.

A sewing machine having a device for adjusting the feed movement of a cloth feed using a revolving stitch regulator that is adjustable relative to a main shaft and having a settling element is known from U.S. Pat. No. 2,643,625.

This device has numbers on the setting element for the stitch regulator which corresponds to adjustment values. The numbers are visible through an opening in the housing in a predetermined position of the main shaft of the sewing machine, when the machine is at a standstill, to be able to adjust the angle of rotation of the setting element to the desired stitch length. With this arrangement the adjusted stitch length cannot be seen during the sewing operation. In addition, for checking the adjusted stitch length, even when the sewing machine stands still, the handwheel of the sewing machine must be brought into a certain position to be able to read the adjusted number through the opening.

SUMMARY OF THE INVENTION

It is an object of the present invention to equip a known stitch regulator having a revolving eccentric, with a display device that is visible also when the sewing machine is in operation.

Accordingly another object of the present invention is to provide a device for adjusting the feed amount of a cloth feeder in a sewing machine having a housing and a main shaft rotatably mounted in the housing, the device comprising a stitch regulator connected to the main shaft for rotation therewith, the stitch regulator having a setting element which is movable with respect to the main shaft for adjusting the feed amount of the cloth feeder, transmission means connected between the stitch regulator and the cloth feeder for moving the cloth feeder with rotation of the main shaft, a pulse generator operatively connected to the main shaft for generating pulses corresponding to stepwise movement of the setting element with respect to the main shaft, locking means for holding the setting element with respect to the main shaft for permitting stepwise movement of the setting element with rotation of the main shaft, a switch operatively engaged with the locking means and connected to the pulse generator for activating the pulse generator, the pulse evaluating means connected to the pulse generator for evaluating pulses from the pulse generator into display data corresponding to the adjusted feed amount, and a display unit connected to the pulse evaluating device for displaying the feed amount.

Through the arrangement according to the invention, the indication of the set feed length is always visible during operation of the sewing machine, and the display device itself can be arranged at any desired point in the operator's range of vision.

A further object of the present invention is to provide a device for adjusting the feed amount of a cloth feeder in a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustration.

DESCRIPTION OF THE PREFERRED EMBODIMENT

Figure 1:
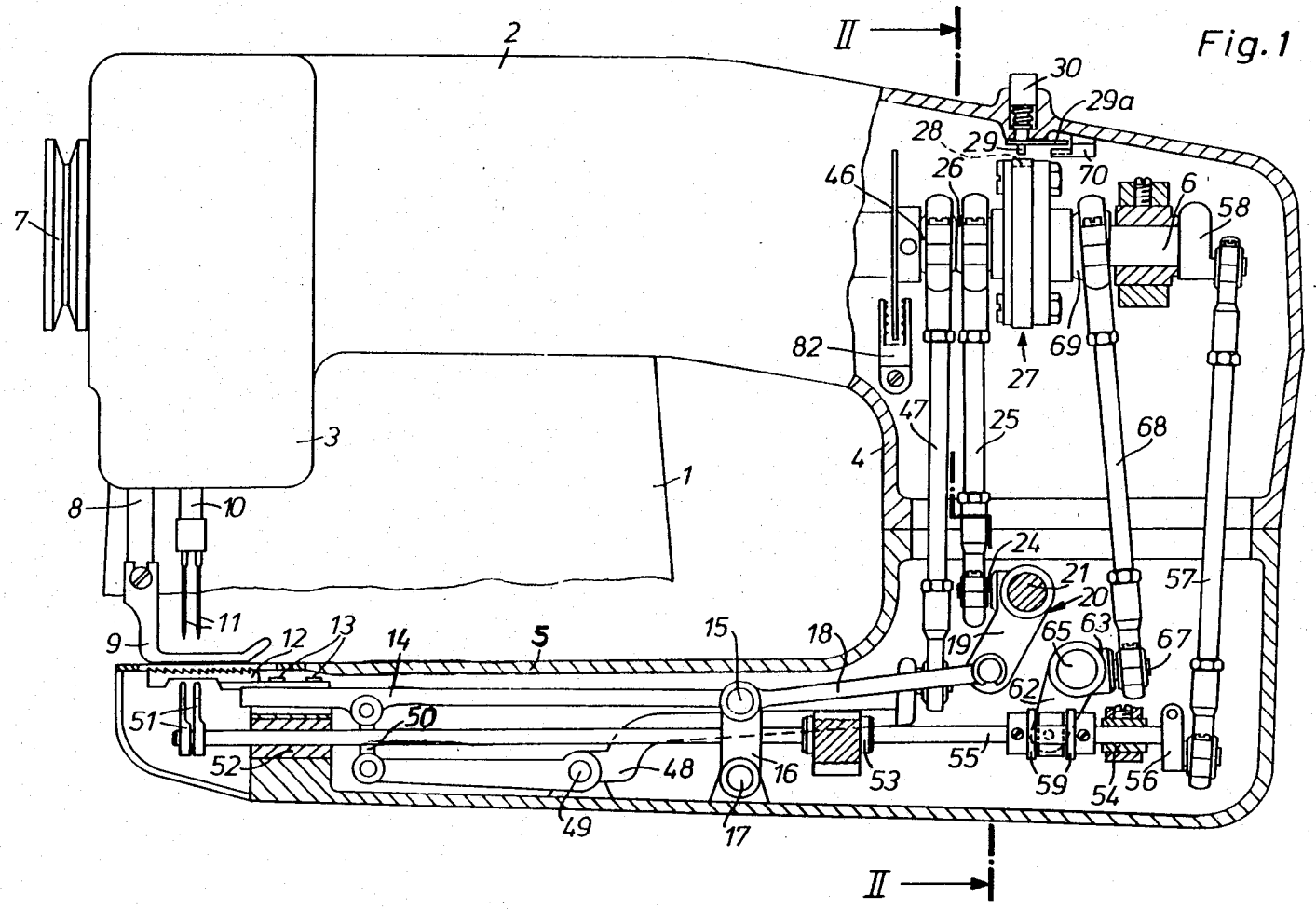
FIG. 1 is a front elevational view of an arm-downward sewing machine of the invention in which the feed device is installed and shown partly in section.

Referring to the drawings in particular, the invention embodied in FIG. 1 comprises a device for adjusting a feed amount of a cloth feeder in a sewing machine having a housing and a main shaft rotatably mounted in the housing. The housing comprises an arm 2 which is fixed to a stand 1. The arm 2 includes, at one end thereof, a head 3 extending forwardly of FIG. 1. An arm 4 extends downwardly from an opposite end of arm 2 and terminates in a support arm 5 whose free end terminates below the head 3.

A main shaft 6 is mounted in arm 2, which carries at the head side, a drive wheel 7. The head has arranged in it, in the usual manner, a presser bar 8 under spring pressure with a presser foot 9 and a vertically movable needle bar 10 which carries two needles 11. The drive of the needle bar 10 occurs in known manner from the main shaft 6 via a crank (not visible in the drwing) for its up and down motion.

Figure 2:
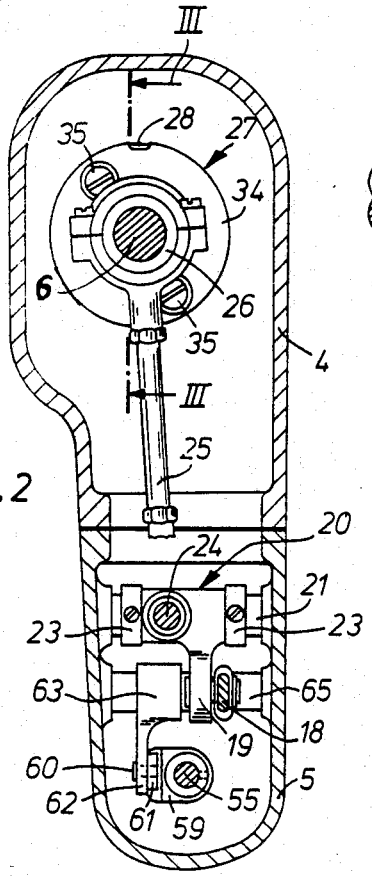
FIG. 2 is a sectional view taken along line II—II of FIG. 1.

At the front end of the support arm 5 a cloth feed or feeder 12 is arranged, which is fastened by screws 13 to a feed bar 14. At its rear end the latter is mounted by a bolt 15 on a rocker 16 rotatable about an axle 17 secured in the support arm 5. One end of a link 18 is fastened on a bolt 15. The other end of link 18 is articulated to an arm 19 of a rocking crank 20 (also see FIG. 2). Crank 20 is mounted on an axle 21 extending through the support arm 5. The center position of crank 20 on axle 21 is fixed by two setting rings 23. Crank 20 has an additional arm 24 with a spherical end to which an eccentric bar 25 is articulated. The other end of bar 25 embraces an eccentric 26 disposed on the main shaft 6. Eccentric 26 cooperates with a stitch regulator 27 which has detent groove 28. A pin 29 of a pushbutton 30 that is under spring action, and which is mounted in arm 4, can enter detent groove 28 from above (FIG. 1).

Figure 3:
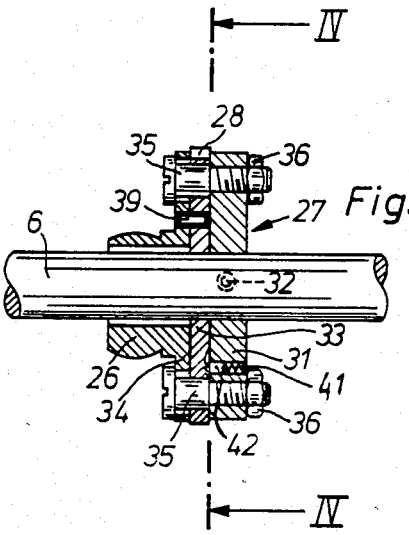
FIG. 3 is a sectional view taken along line III—III of FIG. 2.
Figure 4:
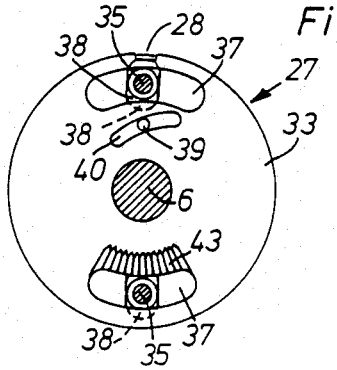
FIG. 4 is a sectional view taken along line IV—IV of FIG. 3.

The stitch regulator 27 for the eccentric 26 comprises a disk-like base body 31 (FIG. 3) which is firmly connected to the main shaft 6 by means of a screw 32. A setting element 33 which is rotatable on the main shaft 6 as well as the actual eccentric support 34, are axially next to base body 31. Parts 31, 32, 33 and 34 are held together by two collar or spacer screws 35 which are screwed tight with the base body 31 by means of nuts 36 and which move easily in arch-shaped slots 37 (FIG. 4) of the setting element 33 and in straight radial slots 38 in the eccentric support 34. Accordingly the setting element 33 is rotatable by an angle corresponding to the arc-shaped slots 37 relative to the main shaft 6, while the eccentric support 34 is displaceable, without rotation, to the main shaft 6 perpendicular thereto according to the length of the straight slots 38. The displacement of the eccentric support 34 crosswise to the main shaft 6, occurs in dependence on the rotation of the setting element 33 due to the fact that a pin 39, fastened in the eccentric support 34, is guided in a curved slot 40 of the setting element 33. To secure the setting element 33 against unintended rotations, and hence the eccentric support 34 against unintended displacements, there is provided in the base body 31 a pawl 42 which, under the action of spring 41 (FIG. 3) engages in ratchet teeth 43 of the setting element 33 and retains the latter flexibly in its adjusted position.

The raising and lowering movement of the cloth feed 12 is derived from the main shaft 6 by means of an eccentric 46 and is transmitted to the front portion of the feed bar 14 via a connecting rod 47, a two-armed lever 48 mounted and centered on a bolt 49 fastened in the support arm 5, and via a double link 50.

Cooperating with the needles 11 is a pair of thread-holding rotary hooks 51 which move crosswise to the feed direction and which are fstened on the front end of a hook rocker shaft 55 longitudinally displaceable and rotatable in bearings 52, 53 and 54. At its rear end the hook rocker shaft 55 carries a clamped-on crank 56 which is in driving connection with a crank 58 fastened at the end of the main shaft 6 via a connecting rod 57. Thereby loop-taking and cast-off movements normal to the sewing direction are imparted to the shuttles 51.

For needle evasion of the rotary hooks 51 in the sewing direction, there are fastened on the hook rocker shaft 55 two claws 59 (FIGS. 1 and 2) between which a sliding block 61 mounted on a bolt 60 is received. Bolt 60 is fastened at the end of an arm 62 of an angular rocker crank 63. The crank 63 is mounted on an axle 65 which is fastened in the support arm 5. By its other arm 67 (FIG. 1) it is in connection through an eccentric rod 68 with an eccentric 69 disposed on the main shaft 6. Thus, constant movements derived from the eccentric 60 are imparted to the hook rocker shaft 55, which movements are transmitted to the rotary hooks as needle evasion movements.

Fastened on pin 29 of pushbutton 30 is an arm **29*a* which cooperates with a switch 80 that is formed as a slit initiator and is secured on arm 4**.

Figure 5:
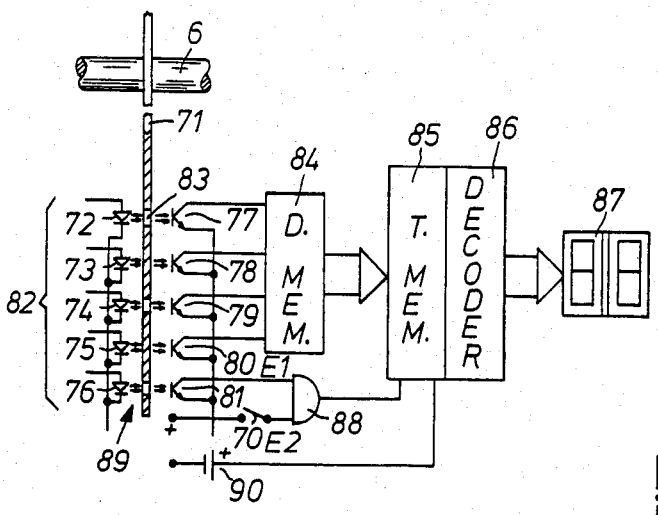
FIG. 5 is block diagram of the circuit for the display device.
Figure 6:
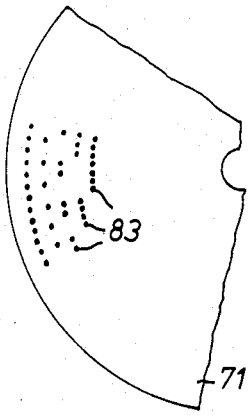
FIG. 6 is a detail of a strobe disc cooperating with the display device.

A strobe disk 71 is fastened on the main shaft 6 (FIG. 5). It cooperates with a pulse generator 82 containing five light emitting disks 72 to 76 and five photo transistors 71 to 81. On the strobe disk 71 five tracks are provided, which contain marking holes 83 with which the light emitting diodes 72 to 76 and the photo transistors 77 to 81 cooperate. On the four inner ones of these tracks the marking holes 83 (FIG. 6) are arranged as a BCD code in angular positions corresponding to the locking positions of the setting disk 33, while in the outer track there is a marking hole 83 in each of these angular positions.

The photo transistors 77 to 80 are connected to the address inputs of a data memory 84, the outputs of which are connected to the inputs of a temporary memory 85 by which it is connected to a decoder 86. The outputs of decoder 86 are connected to a display unit 87.

The photo transistor 81 is connected to an input E1 of an AND element 88, at whose other input E2 a switch 70 is provided. Diode 76 and photo transistor 81 thus form a shift generator 89 for the respective switching position. The output of the AND element 88 is connected to the temporary memory 85 for the control thereof, to which a battery 90 is connected also.

To adjust the eccentric 26, the pushbutton 30 is depressed and the handwheel 7 turned until pin 29 snaps into the detent groove 28 of the stitch regulator 27. With the further rotation of handwheel 7, the setting element 33 is rotated relative to the main shaft 6, namely by angles which correspond to its locking positions. Thus graduated stitch length adjustments corresponding to the locking positions are obtained. The locking positions are determined by teeth 43 into which spring loaded pawl 42 engage, one at a time.

With the lowering of pin 29 into the detent groove 28, arm **29*a* moves into the switch 70, which closes and enables the AND element 88 (FIG. 5). During run-through of the radial rows of marking holes 83 corresponding to the locking positions, the four photo transistors 77 to 80 associated with the inner marking holes cause a selection of the address in the data memory 84, and the outer marking hole 83 associated with each radial row sends a pulse through the shift generator 89 via the AND element 88 to the temporary memory 85, which now takes over the content of the selected address. Via decoder 86 this content is transformed into a display value controlling the display unit 87. The feed amount associated with this marking row then appears in the display unit 87**.

As soon as the stitch adjustment is terminated by release of the pushbutton 30, switch 70 opens again, and the temporary memory 85 no longer takes over any further data from the data memory 84, so that the value indicated by the display unit 87 is preserved until the machine is turned off.

Due to the battery boosting of the temporary memory 85, the value stored in it is maintained also after the machne has been turned off, so that when current is turned on again, the display unit 87 again indicates the set feed amount.

While a specific embodiment of the invention has been shown and described in detail to illustrate the application of the principles of the invention, it will be understood that the invention may be embodied otherwise without departing from such principles.

What is claimed is:

1. A device for adjusting the feed amount of a cloth feeder in a sewing machine having a housing and a main shaft mounted for rotation in the housing, the device comprising a stitch regulator connected to the main shaft for rotation therewith, transmission means connected between said stitch regulator and the cloth feeder for transmitting rotation of the stitch regulator to the cloth feeder, said stitch regulator including a setting element which is movable in steps with respect to the main shaft for adjusting the feed amount, fixing means mounted on the housing and engageable with said setting element for holding said setting element with rotation of the main shaft to permit movement of the setting element by an adjustment amount with respect to the main shaft, a pulse generator operatively connected to the main shaft for delivering pulses corresponding to the adjustment amount, switch means operatively connected to said fixing means and connected to said pulse generator for activating said pulse generator when said fixing means engages said setting element so as to initiate the delivery of pulses, pulse evaluating means connected to said pulse generator for evaluating pulses delivered from said pulse generator, and display means connected to said pulse evaluating means for displaying said adjustment amount.

2. A device according to claim 1, wherein said pulse evaluating means comprises a data memory for storing adjustment amounts, said data memory having address inputs connected to said pulse generator and data outputs, and a decoder connected between said data outputs and said display means.

3. A device according to claim 2, icluding a temporary memory connected between said data memory and said decoder for storing the adjustment amount to be displayed by said display means.

4. A device according to claim 3, wherein said pulse generator comprises a shifting element which is activatable at each adjustment position of said setting element, an AND element having one input connected to said shifting element and another input connected to said switch means, said AND element having an output connected to said temporary memory for shifting said temporary memory with each new adjustment position of said setting element.

5. A device according to claim 4, including a battery connected to said temporary memory for maintaining a content of said temporary memory.

6. A device according to claim 4, wherein said pulse generator comprises a disk fixed to the main shaft having a plurality of marking tracks, a track sensor for each track, one of said track sensors comprising said shifting element in a remainder of said track sensors forming data for addressing data in said data memory.

* * * * *